United States Patent [19]

Hattori

[11] Patent Number: 4,561,400

[45] Date of Patent: Dec. 31, 1985

[54] METHOD OF CONTROLLING AIR-FUEL RATIO

[75] Inventor: Takashi Hattori, Toyota, Japan

[73] Assignee: Toyota Jidosha Kabushiki Kaisha, Toyota, Japan

[21] Appl. No.: 643,712

[22] Filed: Aug. 24, 1984

[30] Foreign Application Priority Data

Sep. 1, 1983 [JP] Japan ..... 58-160915

[51] Int. Cl.[4] ..... F02M 7/00

[52] U.S. Cl. ..... 123/478; 123/480; 123/440

[58] Field of Search ..... 123/478, 480, 440, 489, 123/486, 438, 436

[56] References Cited

U.S. PATENT DOCUMENTS

| | | | |
|---|---|---|---|
| 4,442,815 | 4/1984 | Ninomiya | 123/480 |
| 4,495,921 | 1/1985 | Sawamoto | 123/480 |
| 4,495,925 | 1/1985 | Hasegawa | 123/480 |
| 4,502,442 | 3/1985 | Takakawa et al. | 123/480 |
| 4,522,178 | 1/1985 | Amano et al. | 123/478 |

*Primary Examiner*—Raymond A. Nelli

*Attorney, Agent, or Firm*—Cushman, Darby & Cushman

[57] ABSTRACT

There is disclosed a method of controlling the air-fuel ratio in which the fuel injection rate is controlled by the learning correction coefficient for obstruction of the air flow motor so as to compensate the aging of the air flow meter, and there are a plurality of learning correction coefficients allotted to the predetermined intake air flow rate regions $Q_1$–$Q_n$. The intake air flow rate is measured and the judgement is made as to which region the measured flow rate belongs to. When the measured intake air flowrate is judged to be in any flowrate region other than the flowrate $Q_1$ corresponding to the full closing of a throttle valve, the obstruction compensating learning correction coefficients $FGQ_2$–$FGQ_n$ allotted to all of the flowrate regions excluding the obstruction compensating learning correction coefficient $FGQ_1$ allotted to the flow-rate region $Q_1$ are simultaneously learned.

10 Claims, 16 Drawing Figures

FIG. 7
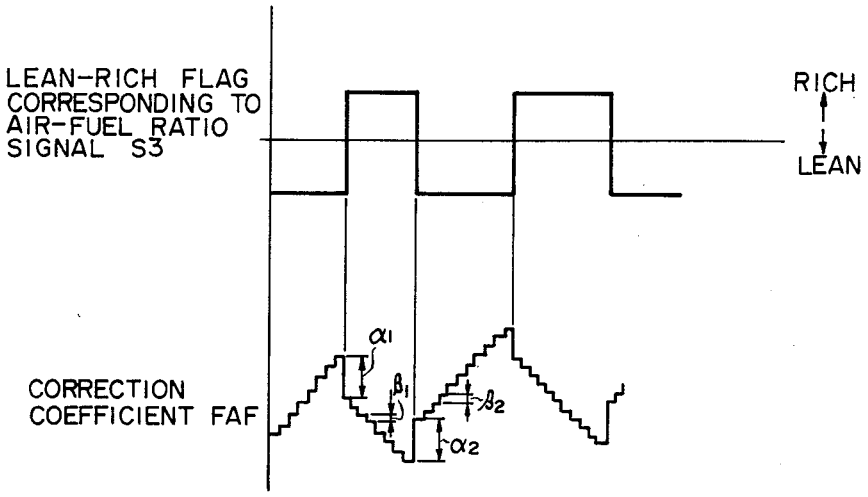
FIG. 10
| FLOWRATE AREA | Q1 | Q2 | Q3 | Q4 | Q5 | Q6 |
|---|---|---|---|---|---|---|
| FLOWRATE ($m^3/h$) | 0~16 | 16~32 | 32~48 | 48~64 | 64~80 | 80~ |
FIG. 11
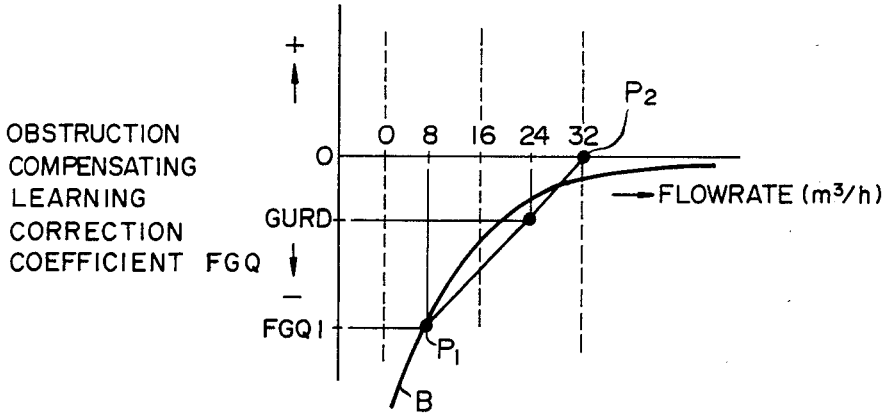

LEARNING CONTROL ROUTINE 2
S51
Qc AREA ?
Q1
Q2
Q3 Q4 Q5 Q6
S52
0.98≦ FAFAV2≦1.02
NO
YES
S53
FGQ1←FGQ1+GKD
FAFAV2←FAFAV2+0.002
S54
-0.20 ≦FGQ1≦0.10 ?
YES
NO
S55
FGQ1 ← -0.20 OR 0.10
S56
FHAC←FHAC+GKF
S63
FAFAV1≧1.0 ?
NO
YES
S64
FGQ2←FGQ2+0.002
FGQ3←FGQ3+0.001
FGQ4←FGQ4+0.001
FGQ5←FGQ5+0.001
FGQ6←FGQ6+0.001
FHAC←FHAC+0.004
S65
FGQ2←FGQ2−0.002
FGQ3←FGQ3−0.001
FGQ4←FGQ4−0.001
FGQ5←FGQ5−0.001
FGQ6←FGQ6−0.001
FHAC←FHAC−0.004
S66
FHAC≧FHACi -0.03
NO
YES
S67
FHAC←FHACi-0.03

| FIG.12A | FIG.12B |
|---|---|

METHOD OF CONTROLLING AIR-FUEL RATIO

BACKGROUND OF THE INVENTION

This invention relates to a method of controlling an air-fuel ratio, and more particularly to a method of controlling an air-fuel ratio, suitable for use in an internal combustion engine for a vehicle, having an electronically controlled fuel injection device.

In an electronically controlled fuel injection device, a basic fuel injection time duration TP is computed on the basis of an engine speed NE detected by a rotational speed sensor and an intake air flowrate Q detected by an intake air flow sensor, and various correction are applied to the basic fuel injection time duration TP in accordance with the engine operating conditions so as to compute a final fuel injection time duration $\tau$. A fuel injection valve is opened to inject the fuel for the final fuel injection time duration $\tau$.

On the other hand, in the fuel injection control device of the type described, in which CO, HC and $NO_x$ are to be simultaneously removed for the exhaust gas emission control measure, it is desired to control the air-fuel ratio in the vicinity of the stoichiometric air-fuel ratio from the viewpoint of the effective removal of the above-mentioned three contents. Therefore, an oxygen sensor is provided in the exhaust gas path, and, under predetermined condition, the feedback correction coefficient FAF is computed so that the air-fuel ratio can approach the vicinity of the stoichiometric air-fuel ratio in accordance with an air-fuel ratio signal from the oxygen sensor, whereby the air-fuel ratio is feedback-controlled.

In the electronically controlled fuel injection device wherein the above-described feedback control of the air-fuel ratio, the air-fuel ratios under the predetermined conditions during the above-described feedback control are learned to compute learning correction coefficient FG in order to compensate a difference in the air-fuel ratio due to the variability of parts, compensate the air-fuel ratio for the running of the vehicle in the highlands (for the high altitude) and compensate a variation in the air-fuel ratio due to change of the intake air flow sensor with time.

For example, the final fuel injection time duration $\tau$ is obtainable through the following equation.

$$\tau = TP \times FAF \times FG \times K$$

where K is a correction coefficient determined by water temperature, intake air temperature and the like.

In learning the aforesaid air-fuel ratio, it must be taken in consideration that the fuel, which has evaporated from a fuel tank and has been accumulated in a canister (hereinafter referred to as the "evaporated fuel"), is fed to a combustion chamber under predetermined condition including that at least the throttle valve is not fully closed, and thus the air-fuel ratio becomes rich temporarily. The influence by the evaporated fuel upon the air-fuel ratio is as shown in FIG. 1. In an extreme case, the intake air flowrate Q becomes about 10% rich even in a region of a high air flowrate as high as 100 $m^3/h$. In consequence, if the operation of the vehicle is stopped immediately after the change in the air-fuel ratio due to the evaporated fuel as described above is learned, then the air-fuel ratio would become excessively lean when the vehicle is started again, thus presenting the disadvantage of lowered startability. For this reason, there is no need to learn the air-fuel ratio, which has become rich due to the evaporated fuel.

The compensation of the air-fuel ratio for the aforesaid high altitude prevents the air-fuel ratio from becoming richer. More specifically, since the higher the altitude is, the lower the air density becomes, the air-fuel ratio becomes richer when the vehicle runs at the highlands. Therefore, in the compensation for the high altitude, the fuel injection rate is adapted to get less as the altitude becomes higher. The influence by the altitude of the highland upon the air-fuel ratio is substantially constant irrespective of the intake air flowrate as shown in FIG. 2. Because of this, in a region other than the region where the throttle valve is fully closed, it is difficult to attribute the air-fuel ratio being rich to whether the evaporated fuel or the altitude of the highland.

On the other hand, when the intake air flow sensor is obstructed due to a change with time, as indicated by a curve B in FIG. 3, the less the intake air flowrate in any region is, the more influence to the air-flow rate in such a region is given.

According to the air-fuel ratio learning control method proposed by the inventors of the present invention, an intake air flowrate is divided into 16 flowrate regions $Q_1$–$Q_{16}$ for example. When the air-fuel ratio is on the lean side of the stoichiometric air fuel ratio, a predetermined number is added to obstruction compensating learning correction coefficients $FGQ_c$ for the latest flowrate region $Q_c$, $FGQ_{c-1}$ for a flowrate region before $Q_c$ and $FGQ_{c-1}$ for a flowrate region after $Q_c$, and, when the air-fuel ratio is on the rich side, the predetermined number is subtracted therefrom. In addition to this calculation, a value obtained by dividing the total sum of the obstruction learning correction coefficients $FGQ_1$–$FGQ_{16}$ for all of the flowrate regions $Q_1$–$Q_{16}$ is made to be an altitude compensating learning correction coefficient FHAC. Then, in consideration of the influence by the evaporated fuel, the obstruction compensating learning correction coefficient FGQ is guarded within a predetermined range centered about a step-shaped guard line G as shown in FIG. 3.

In the above-described air-fuel ratio learning control thus proposed, if the operation is performed only in the specific flowrate region, such a disadvantage is presented that the obstruction compensating learning correction coefficient FGQ and the altitude compensating learning correction coefficient FHAC are learned only in the specific flowrate region. In consequence, there is such a possibility that, when a motor vehicle provided with such a air-fuel ratio learning control goes up to highlands only in the large flowrate region for example, the learning cannot be performed in the small flowrate region. Accordingly, the air-fuel ratio becomes over-rich due to the high altitude, so that the engine may not start.

On the other hand, in such a learning control, in order to obviate the influence by the evaporated fuel, the obstruction compensating learning correction coefficient FGQ is limited as indicated by a regulated value G as shown in the aforesaid FIG. 3. However, the air-fuel ratio is influenced by the evaporated fuel within the range defined the curve B and the line G. Further, since the above-described regulated value is set as shown in FIG. 3, the obstruction compensating learning correction coefficient FGQ cannot be regulated in accordance with the characteristics of obstruction of the air flow meter as indicated by a curve B in FIG. 3. Furthermore, after the obstruction compensating learning correction coefficient FGQ is regulated by the regulated value G in all of the flowrate regions, the altitude compensating cannot be satisfactorily effected.

SUMMARY OF THE INVENTION

The present invention has been developed to obviate the above-described disadvantages of the prior art and has as its object the provision of a method of controlling an air-fuel ratio, wherein the optimum learning of the air-fuel ratio can be carried out.

A first aspect of the present invention is directed to a method of controlling the air-fuel ratio in which the fuel injection rate is controlled by the learning correction coefficients $FGQ_1$–$FGQ_n$ for obstruction of the air flow meter so as to compensate the aging of the air flow meter, and a plurality of the learning correction coefficients $FGQ_1$–$FGQ_n$ are allotted to the predetermined intake air flow rate regions $Q_1$–$Q_n$. The intake air flow rate is measured and the judgement is made as to which region the measured flow rate belongs to. When the measured intake air flowrate is judged to be in any flowrate region other than the flowrate $Q_1$ corresponding to the full closing of a throttle valve, the obstruction compensating learning correction coefficients $FGQ_2$–$FGQ_n$ allotted to all of the flowrate regions excluding the obstruction compensating learning correction coefficient $FGQ_1$ allotted to the flowrate region $Q_1$ are simultaneously learned.

A second aspect of the present invention is directed to a method of controlling the air-fuel ratio in which the fuel injection rate is controlled by use of the learning correction coefficients $FGQ_1$–$FGQ_n$ and FHAC for obstruction of the air flow meter and for high altitude of the highlands where the motor vehicle travels and a plurality of the learning correction coefficients $FGQ_1$–$FGQ_n$ are allotted to the predetermined intake air flow rate regions $Q_1Q_n$. The measurement of the intake air flow and the judgement of flow rate region are carried out as described hereinbefore. A judgement is made whether all of these learning correction coefficients $FGQ_1$–$FGQ_n$ are negative or positive. When all of these learning correction coefficients $FGQ_1$–$FGQ_n$ are negative, a predetermined number is subtracted from the altitude compensating learning correction coefficient FHAC and a predetermined number is added to the learning correction coefficients $FGQ_1$–$FGQ_n$, respectively, and, when all of these learning correction coefficients $FGQ_1$–$FGQ_n$ are positive, a predetermined number is added to the altitude compensating learning correction coefficient FHAC and a predetermined number is subtracted from the obstruction compensating learning coefficients $FGQ_1$–$FGQ_n$, respectively.

A third aspect of the present invention is directed to a method of controlling the air-fuel ratio in which the fuel injection rate is controlled by the learning correction coefficients $FGQ_1$–$FGQ_n$ for obstruction of the air flow meter so as to compensate the aging of the air flow meter, and a plurality of the learning correction coefficients $FGQ_1$–$FGQ_n$ are allotted to the predetermined intake air flow rate regions $Q_1$–$Q_n$. The intake air flow rate is measured and the judgement is made as to which region the measured flow rate belongs to. A lower limit for the learning correction coefficient FGQ corresponding to the flow rate adjacent to the flow rate region $Q_1$ is determined by a line connecting a point $P_1$ indicative of the learning correction coefficient $FGQ_1$ to a point $P_2$ indicative of zero of the learning correction coefficient FGQ at a predetermined flow rate within a predetermined flow rate region.

According to the first and the second aspects of the invention, even when the engine is driven in a specific flowrate region, the obstruction compensating learning correction coefficients FGQ of the other flowrate regions are learned. Accordingly, a satisfactory drivability can be obtained when the engine is driven in the medium flowrate region after the motor vehicle climbs the highlands only by use of the large flowrate region.

Furthermore, according to the second aspect of the invention, the altitude compensation can be performed through the utilization of the obstruction compensating learning correction coefficients $FGQ_1$–$FGQ_n$ originally used for compensating of the dispersions of the air fuel ratio in the flowrate regions rather than the altitude compensation and having upper and lower limit values thereof set within a relatively narrow range, so that the altitude compensation can be carried out more reliably.

According to the third aspect of invention, the lower limit of the obstruction compensating learning correction coefficients FGQ is substantially coincide with the obstruction characteristics of the air flow meter, so that an appropriate air-fuel ratio control as commensurate to the degree of obstruction of the air flow meter can be carried out.

BRIEF DESCRIPTION OF THE DRAWINGS

FIG. 7 is a time chart showing a flag corresponding to the air-fuel ratio signal S3 and the correction coefficient FAF;

FIG. 10 shows the flowrate regions $Q_1$–$Q_6$ and the flowrates thereof;

FIG. 11 shows the restricted values of the obstruction compensating learning correction coefficient FGQ.

DESCRIPTION OF THE PREFERRED EMBODIMENT

Figure 1:
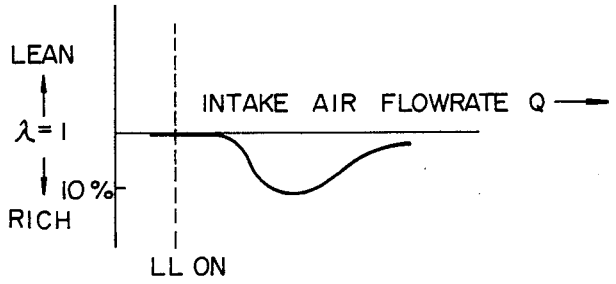
FIG. 1 shows the influence of the evaporated fuel to the air fuel ratio.
Figure 2:
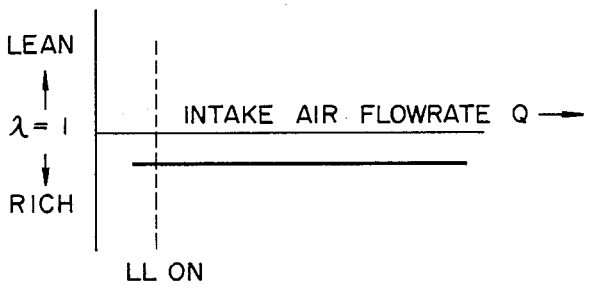
FIG. 2 shows the influence of the altitude of the highland to the air-fuel ratio.
Figure 3:
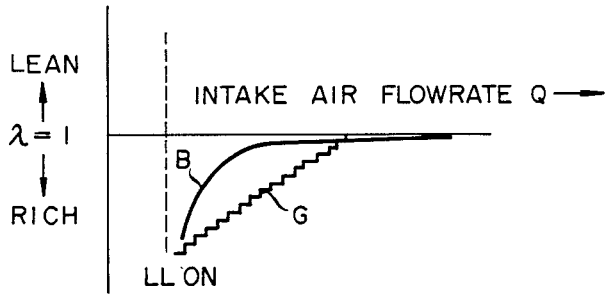
FIG. 3 shows the influence of the obstruction due to the intake air flowrate to the air fuel ratio.
Figure 4:
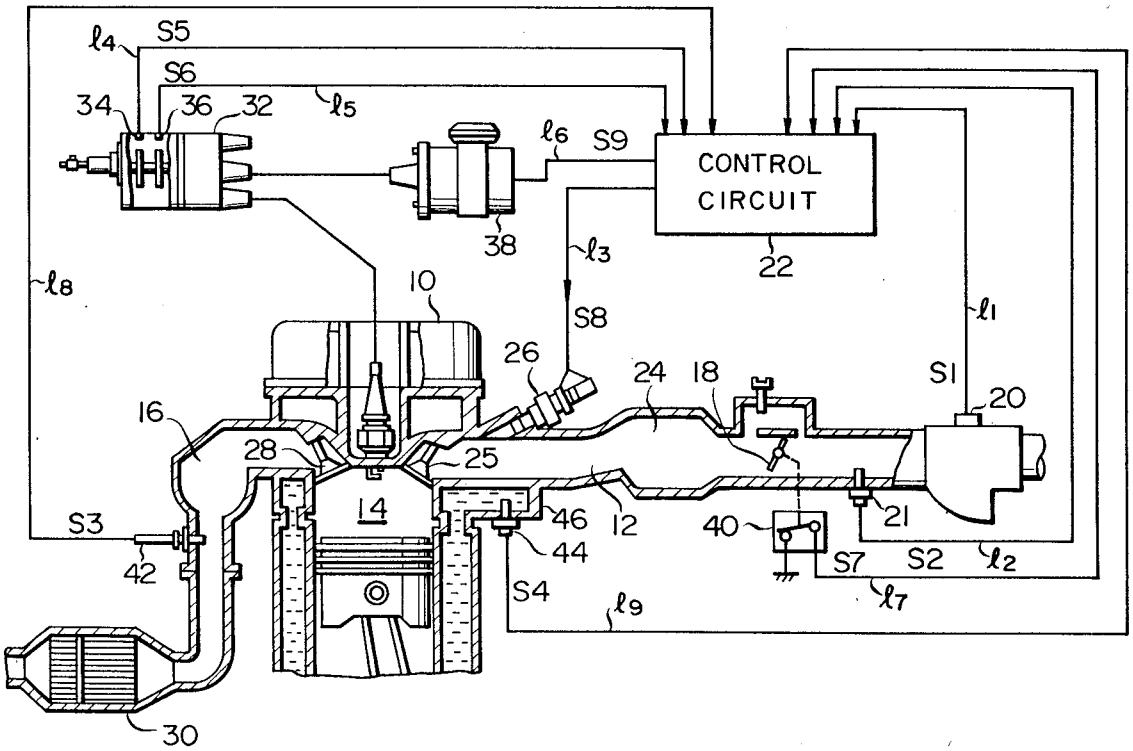
FIG. 4 is an arrangement diagram showing one example of the internal combustion engine to which the present invention is applied.

FIG. 4 shows an example of an electronically control fuel injection type internal combustion engine, to which the present invention is applied. Designated at 10 is a main body of engine, 12 an intake passage, 14 a combustion chamber, and 16 an exhaust passage, respectively. An intake air flow sensor (air flow meter) 20 provided in the intake passage 12 upstream of the throttle valve 18 is connected to a control circuit 22 through a signal line 11, for generating a voltage commensurate to an intake air flowrate. An intake air temperature sensor 21 is provided in the intake passage 12 upstream of the throttle valve 18 and connected to the control circuit 22 through a signal line l2, for generating a voltage commensurate to intake air temperature. Intake air taken in through an air cleaner (not shown) and the intake air flow sensor 20 and controlled in its flowrate by the throttle valve 18 operationally associated with an accelerator pedal (not shown) is led to combustion chambers 14 of respective cylinders through a surge tank 24 and an inlet valve 25.

The fuel injection valves 26 are provided on every cylinders and on-off operated in accordance with electrical driving pulses fed from the control circuit 22 through a signal line l3. In response to the pulses, the fuel injection valves 26 intermittently inject pressurized fuel fed from a fuel supply system (not shown) into the intake passage 12 in the vicinity of the intake valve 25, i.e. an intake port portion. The exhaust gas after the combustion in the combustion chamber 14 is discharged to atmosphere via exhaust valves 28, the exhaust passage 16 and a three-way catalytic converter 30.

Mounted on a distributor 32 of the engine are crank angle sensors 34 and 36, which are connected to the control circuit 22 via signal lines l4 and l5. These sensors 34 and 36 produce pulse signals each time the crankshaft rotates through 30° and 360°, respectively, and the pulse signals are delivered to the control circuit 22 through a signal line l6.

Designated at 40 is an idle switch (LL switch) operationally associated with the throttle valve 18, for being closed when the throttle valve 18 is fully closed, and connected to the control circuit 22 through a signal line l7.

In the exhaust passage 16, there is provided an $O_2$ sensor for producing a signal in response to the concentration of oxygen in the exhaust gas, i.e. generating output voltage which stepwise changes around the stoichiometric air-fuel ratio, and the output signal is delivered to the control circuit 22 through a signal line l8. The three-way catalytic converter 30 is provided downstream of this $O_2$ sensor 42 and simultaneously purifies the three harmful contents in the exhaust gas, i.e. HC, CO and $NO_x$.

Furthermore, denoted at 44 is a water temperature sensor for detecting a coolant temperature of the engine, mounted on a cylinder block 46, and connected to the control circuit 22 through a signal l9.

Figure 5:
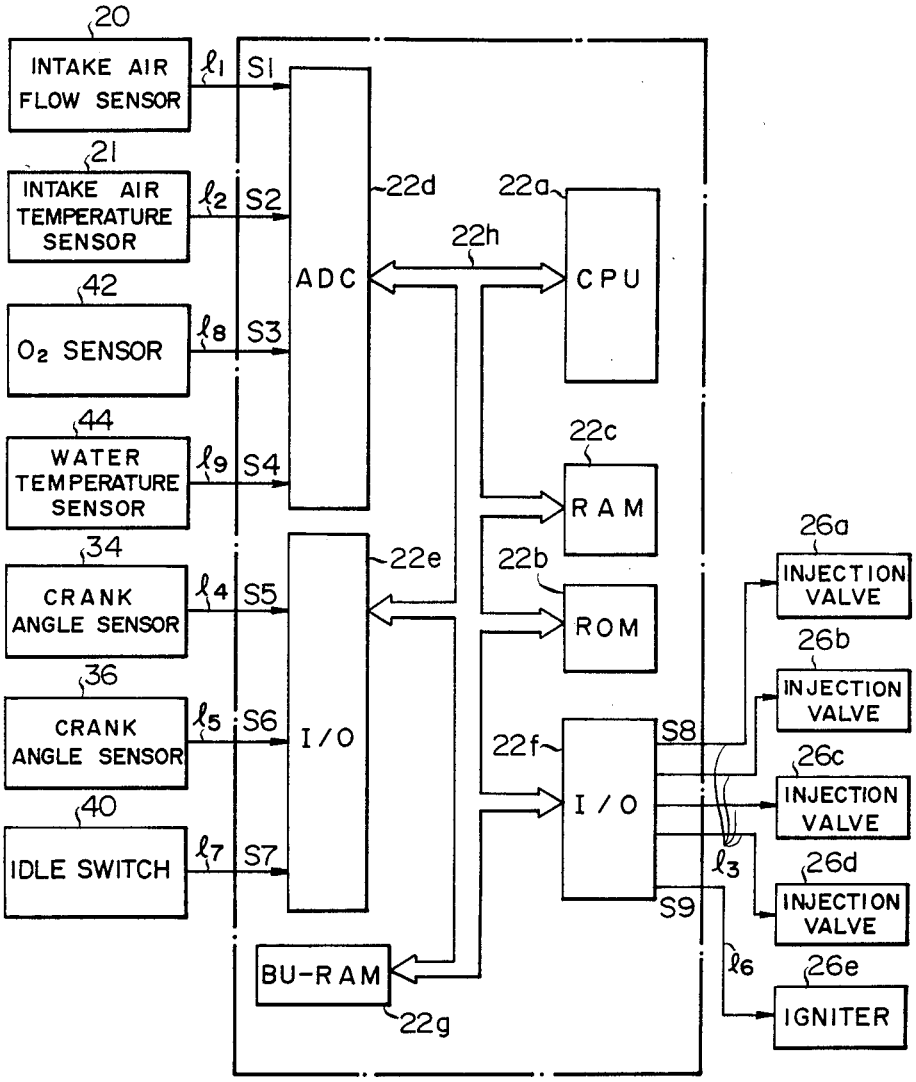
FIG. 5 is a block diagram showing one example of control circuit thereof in detail.

As shown in FIG. 5, the control circuit 22 comprises: a central processing unit (CPU) **22*a* for controlling various components; a read only memory (ROM) 22*b*, into which various numerical values and programs are previously written; a random access memory 22*c*, in which numerical values and flags obtained during computation process are written into a predetermined area; an A/D converter (ADC) 22*d* having an analogue multiplexer function, for converting an analogue input signal into a digital signal; an input/output interface (I/O) 22*e*, into which various digital signals are inputted; an input/output interface (I/O) 22*f* for outputting various digital signals; a backup memory (BU-RAM) 22*g* for being supplied with electricity from an auxiliary power source when the engine is out of operation to maintain the memory; and a bus line 22*h*** for connected the above-described components to one another.

In the ROM **22*b***, there are previously stored a main process routine program, a program for computing a fuel injection time duration (pulse-width), a program for computing an air-fuel ratio feedback correction coefficient and a learning correction coefficient to be described hereunder, other various programs and various data necessary for computation of the above programs.

The air flow meter 20, the intake air temperature sensor 21, the $O_2$ sensor 42 and the water temperature sensor 44 are connected to the A/D converter **22*d*, whereby voltage signals S1, S2, S3 and S4 from the respective sensors are successively converted into binary signals in response to the instructions from CPU 22*a***.

A pulse signal S5 from the crank angle sensor 34 through each crank angle 30°, a pulse signal S6 from the crank angle sensor 36 through each crank angle 360° and an idle signal S7 from an idle switch 40 are taken into the control circuit, respectively, through the I/O **22*e*. A binary signal representing an engine speed is formed in response to the pulse signal S5, and the pulse signals S5 and S6 cooperate with each other to form a signal required for the computation of the fuel injection pulse-width, an interruption signal for beginning the fuel injection, a cylinder identification signal and the like. Furthermore, it is judged whether the throttle valve 18 is substantially fully closed or not by the idle signal S7**.

A fuel injection signal S8 and an ignition signal S9, which have been formed by various computations, are delivered from the I/O **22*f* to fuel injection valves 26*a*–26*d* and an igniter 38**, respectively.

A fuel injection time duration (quantity of injection) in an internal combustion engine with the above-described arrangement is determined by the following formula for example.

$$\tau = TP \times FAF \times FG \times K \quad (1)$$

where $\tau$ is the final fuel injection time duration,
TP a basic fuel injection time duration,
FAF a feedback correction coefficient,
FG a learning correction coefficient, and
K a correction coefficient by water temperature, intake air temperature and the like.

The basic fuel injection time duration TP is read from a predetermined table or obtained by computations on the basis of an intake air flowrate Q and an engine speed NE.

Under the feedback control condition, if the air-fuel ratio is judged to be lean in response to the air-fuel ratio signal S3 from the $O_2$ sensor 42, then the feedback correction coefficient FAF comes to be a value to increase the quantity of fuel injection, e.g. 1.05. If the air-fuel ratio is judged to be rich in response to the air-fuel ratio S3, then the feedback correction coefficient FAF comes to be a value to reduce the quantity of injection, e.g. 0.95. Not under the condition of feedback, the correction coefficient FAF comes to be 1.0.

Figure 6:
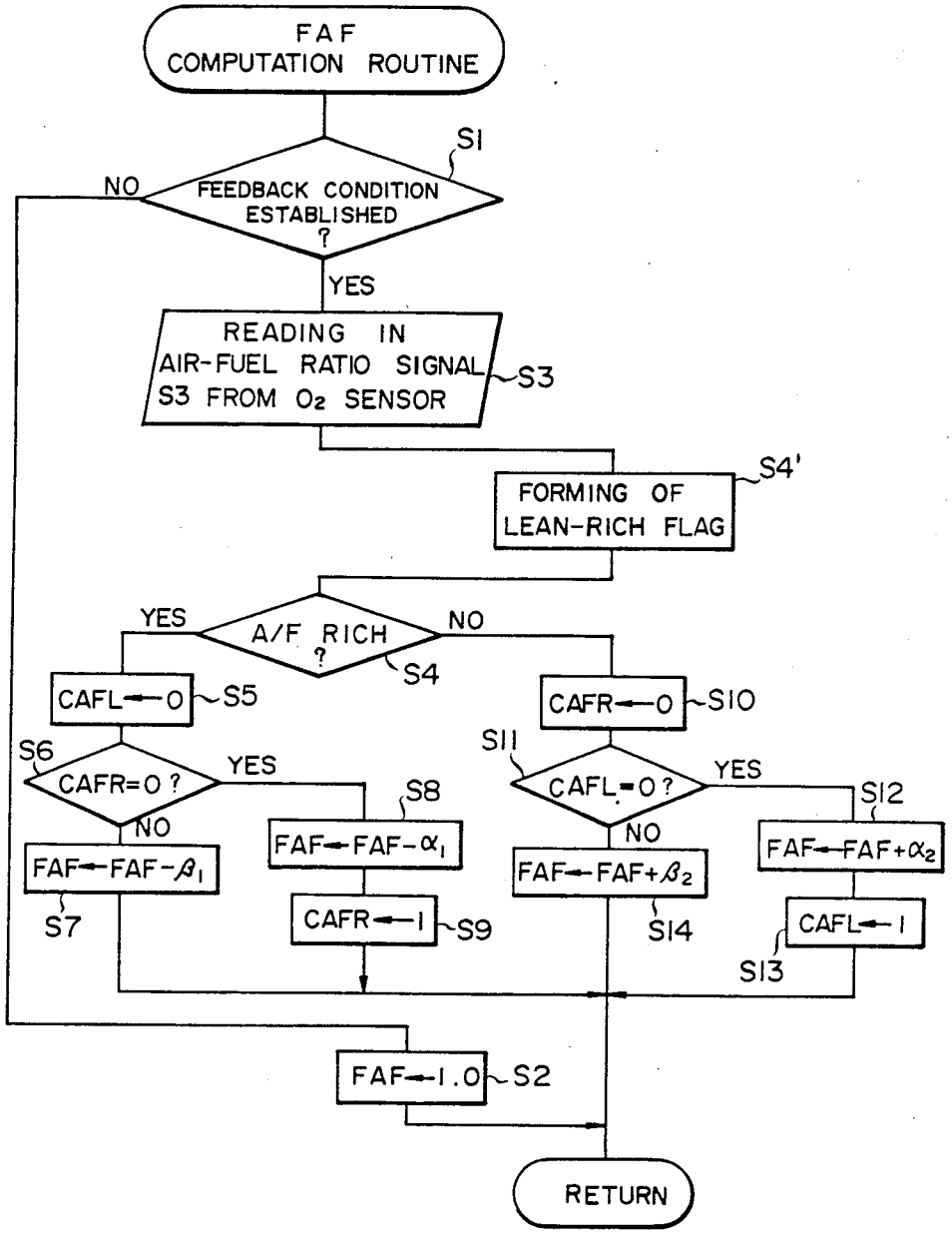
FIG. 6 is a flow chart showing one example of the feedback correction coefficient.

FIG. 6 shows an example of the computation steps of the feedback correction coefficient.

In a step S1, it is judged if the feedback control condition is established or not. The feedback control condition is established, when it is not the starting condition, not during the increase of the fuel flow rate after the start of the engine, engine water temperature THW is 50° C. or more, and not during the increase of the fuel flow rate for acceleration, for example. If the feedback control condition is not established, then, in a step S2 the feedback correction coefficient FAF is set at 1.0 not to allow the feedback control to be effected, thus ending this routine. If the feedback control condition is established, then the process proceeds to a step S3. In a step S3, the air-fuel ratio is read on the basis of the signal S3. In a step S4, an air-fuel ratio lean-rich flag is formed in accordance with a voltage value represented by the air-fuel ratio signal S3. When the air-fuel ratio is rich, the flag is set to be "1" and, when the air-fuel ratio is lean, the flag is reset to be "0". In a step S4, when the flag indicates "1", the air-fuel ratio is judged to be rich, and a process goes to successive steps where an air-fuel mixture is adapted to get leaner.

More specifically, in a step S5, a flag CAFL is set to be zero, and the process proceeds to a step S6 in which a judgement is made as to whether or not the flag CAFR is zero. When the air-fuel mixture is shifted to the rich side for the first time, since the flag CAFR has come to be zero, the process proceeds to a step S8 in which a predetermined value $\alpha 1$ is subtracted from the correction coefficient FAF stored in the RAM 22*b*. The result of the subtractive calculation is made to be the new correction coefficient FAF. In a step S9, the flag CAFR is made to be 1. In consequence, when the air-fuel ratio is judged to be rich continuously twice or more in the step S4, in the step S6 through which the process passes through after the two times, the negative judgement is made without fail. In the step S7, a predetermined value $\beta 1$ is subtracted from the correction coefficient FAF and the result of calculation is made to be the new correction efficient FAF, thus finishing this computing process.

On the other hand, the lean-rich flag based on the voltage represented by the signal S3 in the step S4 is "0", the air-fuel ratio is judged to be lean, so that a process of shifting the air-fuel ratio to the rich side is conducted. More specifically, the flag CAFR is set to be zero in a step 10 and the process proceeds to a step S11 in which a judgement is made whether or not the flag CAFR is zero. When the air-fuel mixture is shifted to the leaner side for the first time, the process proceeds to a step S12 because the flag CAFL has set to be "0". In the step S12, a predetermined value $\alpha 2$ is added to the correction coefficient FAF and the result of calculation is made to be the new correction coefficient FAF. In a step S13, the flag CAFL is made to be 1. In consequence, if the air-fuel ratio is judged to be lean continuously two or more times, then, in the step S11 through which the process passes through the two times, the negative judgement is made without fail. In a step S14, a predetermined value $\beta 2$ is added to the correction coefficient FAF and the result of calculation is made to be the new correction efficient FAF, thus completing the computation of FAF.

Additionally, $\alpha 1$, $\alpha 2$, $\beta 1$ and $\beta 2$ in the steps S7, S8, S12 and S14 are predetermined values, respectively.

FIG. 7 shows the feedback correction coefficient FAF obtained from this computing steps and a lean-rich flag corresponding to the voltage value indicated by the air-fuel ratio signal S3. Referring to this drawing, when the air-fuel ratio is shifted from lean to rich or from rich to lean, the correction coefficient FAF is skipped by $\alpha 1$ or $\alpha 2$. If the air-fuel ratio is kept lean, then a predetermined number $\beta 1$ is successively added to the correction coefficient FAF, whereas, if the air-fuel ratio is kept rich, then a predetermined number $\beta 2$ is successively subtracted from the correction coefficient FAF.

A learning correction coefficient FG to be determined in the control method according to the present invention is represented by the following formula.

$$FG=(1+FHAC+FGQ) \quad (2)$$

where FHAC represents the altitude compensating learning correction coefficient, and FGQ represents the obstruction compensating learning correction coefficients of air flow meters in the flowrate regions.

Figure 8:
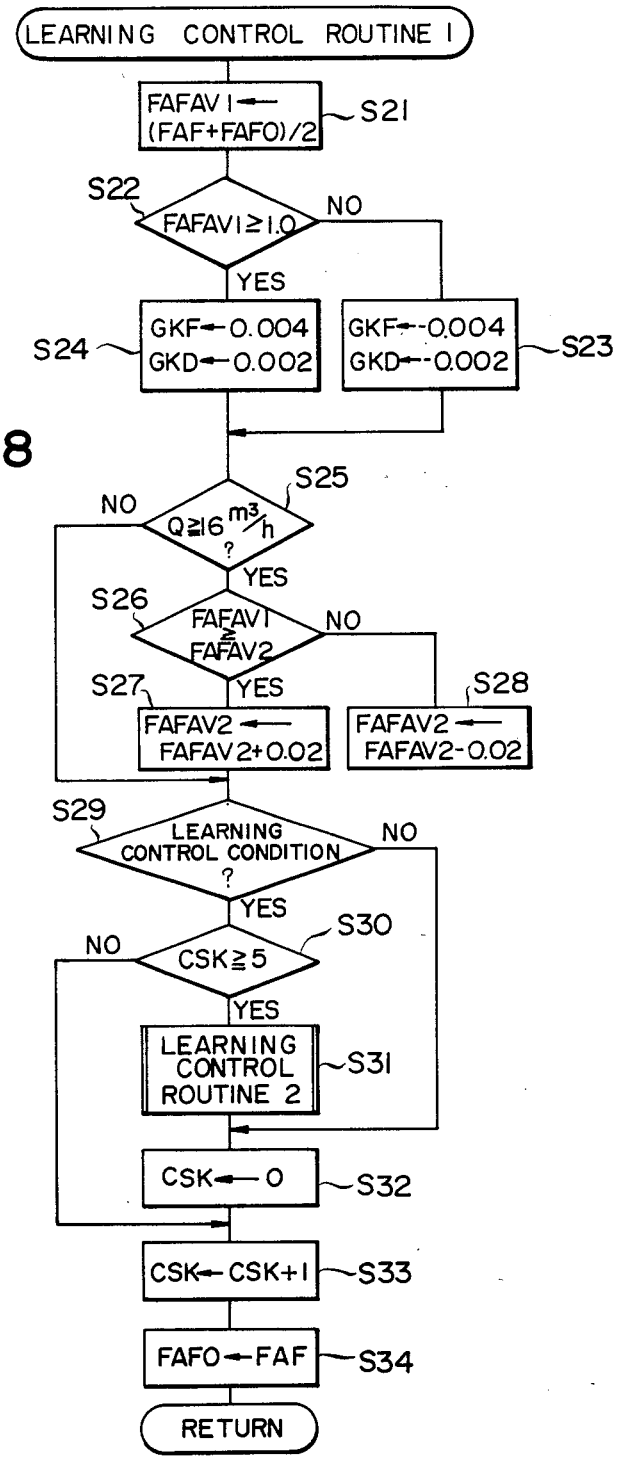
FIGS. 8 and 9*a* & 9*b* are flow charts showing one and another examples of the learning control.
Figures 9, 9A, 9B:
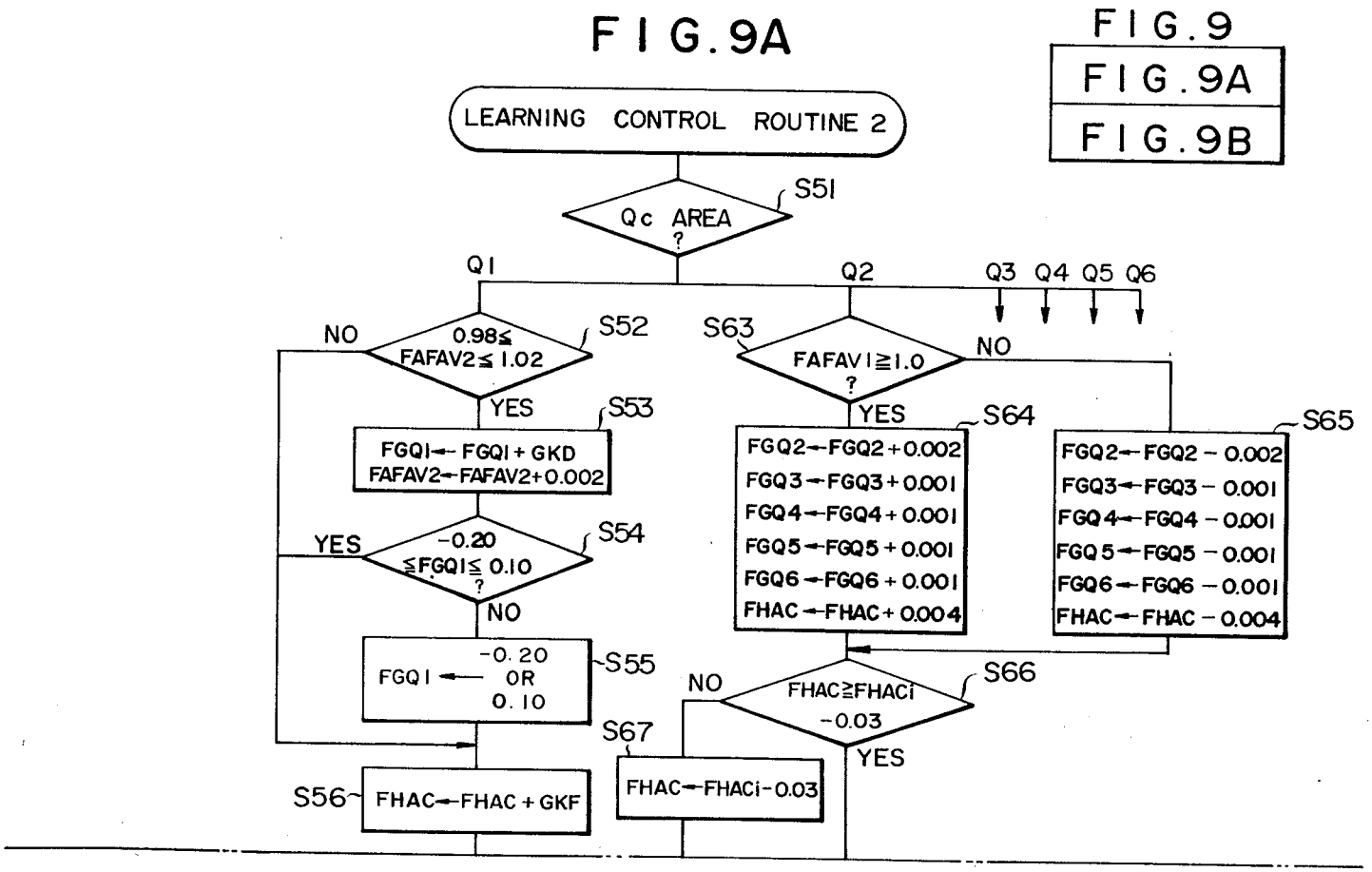
Figure 9B:
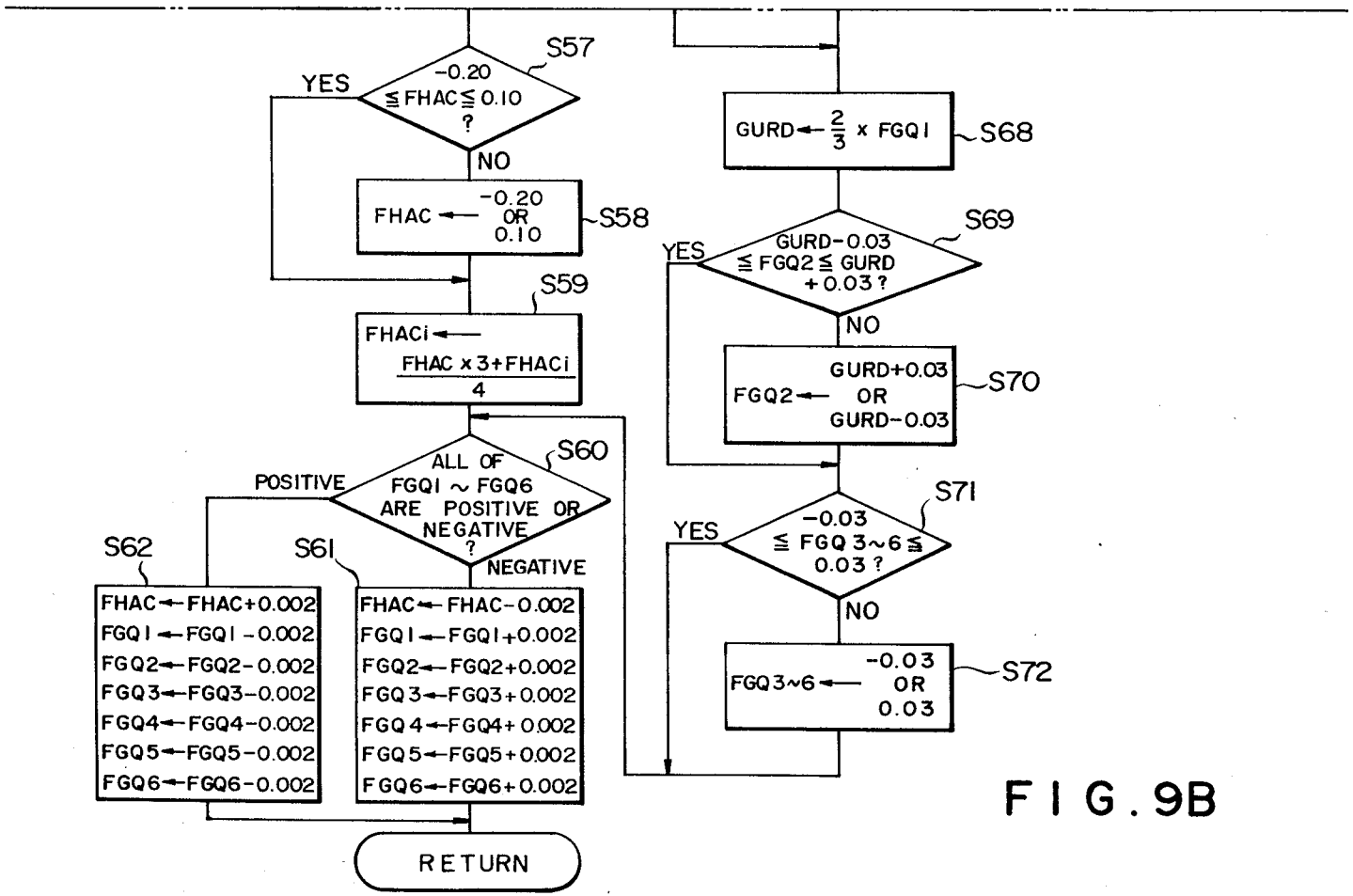
Figures 12, 12A:
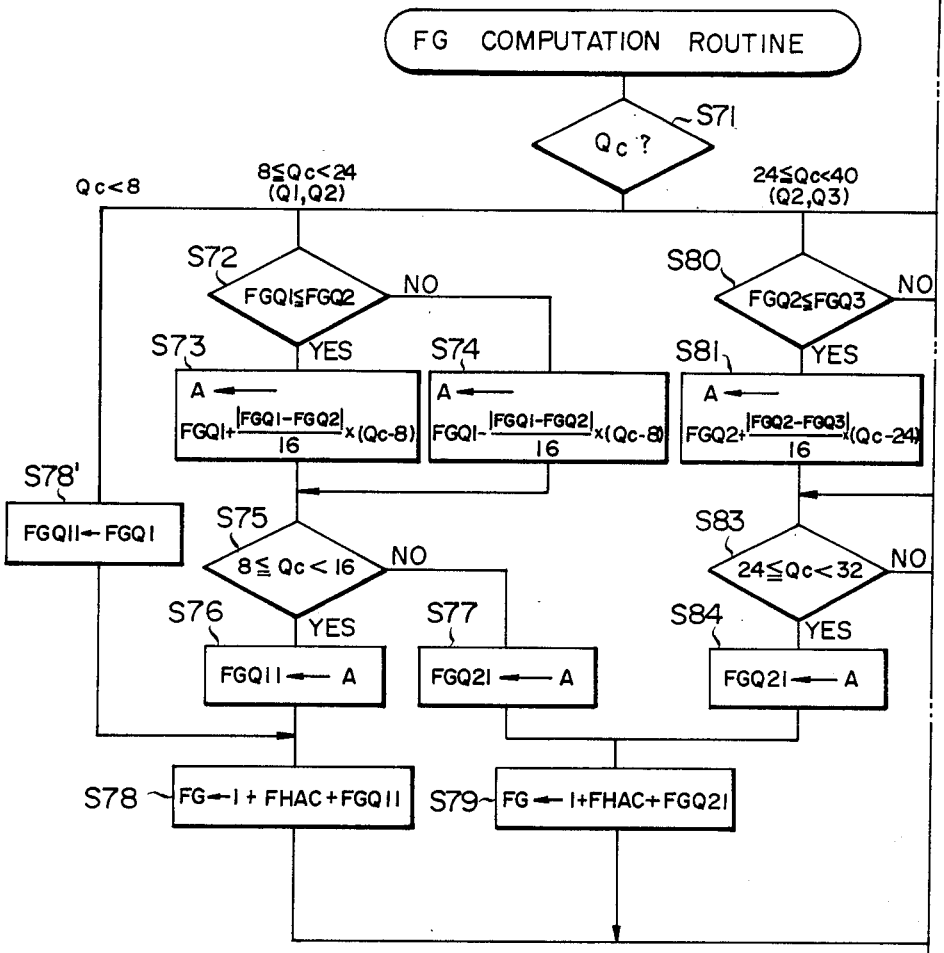
FIGS. 12, 12A and 12B are a flow chart showing one example of the routine of computing the learning correction coefficient FG.
Figure 12B:
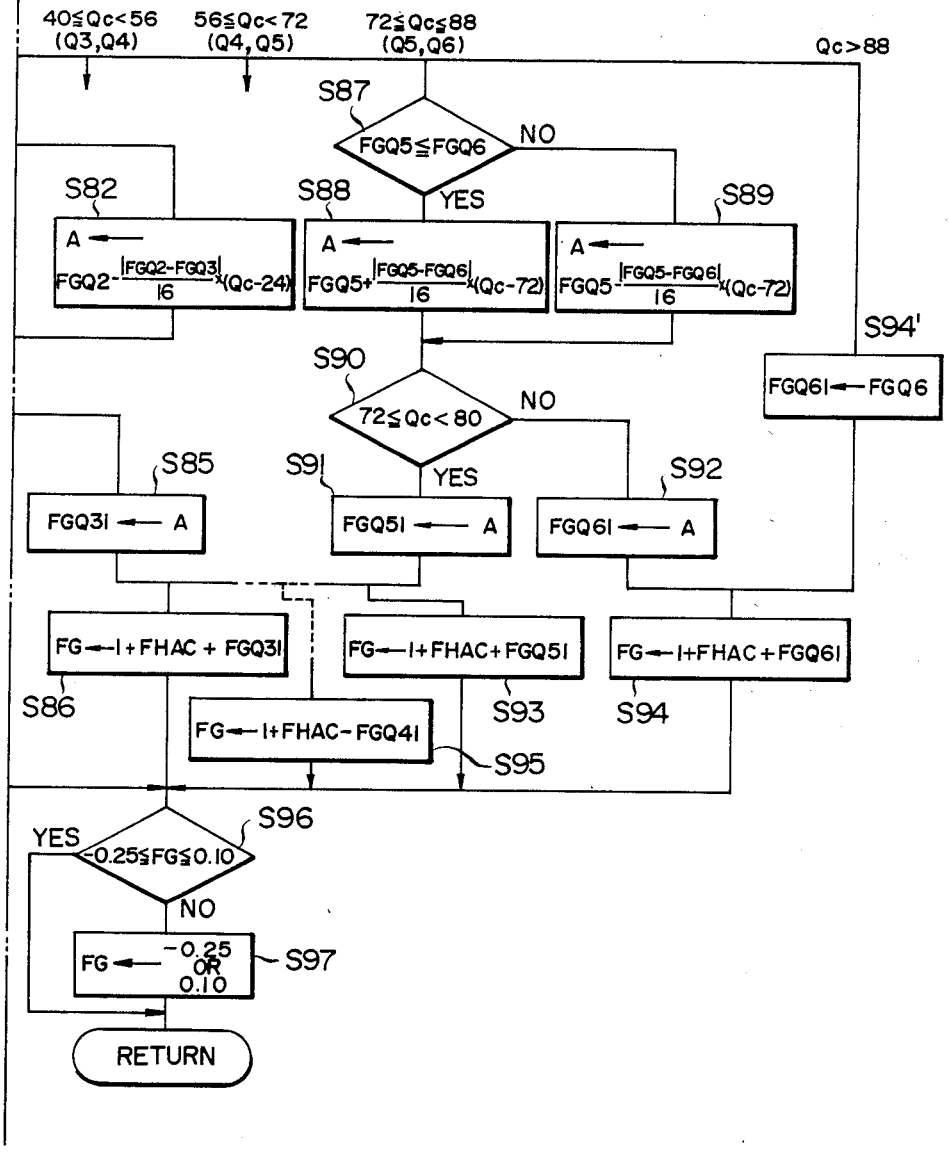

The learning correction coefficient FG is computed in accordance with the routine described in FIGS. 8, 9 and 12.

The learning control routine 1 shown in FIG. 8 is started immediately before each skipping of the correction coefficient FAF. In a step S21, calculation is made to determine an arithmetical mean value FAFAV1 between the latest correction coefficient FAF and the preceding correction coefficient FAFO, i.e. the two new and old values. The process proceeds to a step S22 in which a judgement is made as to whether or not the mean value FAFAV1 is 1 or more. If the mean value FAFAV1 is less than 1, the process proceeds to a step S23 where a learning amount for altitude compensation GKF is set at −0.004 and an learning amount for obstruction compensation GKD is set at −0.002. If the mean value FAFAV1 is 1 or more, the process proceeds to a step S24 where the learning amount GKF is set at 0.004 and the learning amount GKD is set at 0.002.

In a step S25, a judgement is made as to whether or not Q is 16 $m^3/h$ or more, i.e. as to whether the air flow rate Q belongs to one of the flowrate regions $Q_2$–$Q_n$. If the judgement is affirmative, then the process proceeds to a step S26 in which a judgement is made as to whether or not the aforesaid mean value FAFAV1 is the reference value FAFAV2 or more. The reference value FAFAV2 is used as a judging reference of renewal of the learning correction coefficient DFC. The FAFAV2 is set at "1" at the time of the start of engine and increased or decreased under a predetermined condition. If the mean value FAFAV1 is the reference FAFAV2 or more, the process proceeds to a step S27 where 0.002 is added to the reference value FAFAV2. If the mean value FAFAV1 is less than the reference value FAFAV2, the process proceeds to a step S28 where 0.002 is subtracted from the reference value FAFAV2.

If the judgement is negative in the step S25, or the steps S27 and S28 are finished, then, the process proceeds to a step S29. In the step S29, a judgement is made as to whether or not the learning condition is satisfied. It is an essential condition that the air-fuel ratio is in the course of feedback control, and, in addition to it, when the temperature of the engine cooling water is 70° or more, the learning condition is satisfied. In the judgement is affirmative in the step S29, then, the process proceeds to a step S30 in which a judgement is made as to whether or not the count of a counter CSK for counting a number of skips of the correction coefficient FAF is 5 or more. If the judgement is affirmative in the step S30, then, the process proceeds to a step S31 in which a learning control routine 2 shown in FIG. 9 is carried out. Then, in a step S32, the counter CSK is reset to be "0".

In the judgement is negative in the step S30 or the step S32 is completed, then, the process proceeds to a step S33 in which the counter CSK is caused to count up by +1. In a step 34, the preceding correction coefficient FAFO is rewritten by the latest correction coefficient FAF, thus completing this routine. If the judgement is negative in the step S29, the steps S30 and S31 are skipped so that the process jumps to the step S32.

Description will hereunder be given of the learning control routine in a step S31 with reference to FIG. 9.

When this routine is started, in the step S51, a judgement is made as to which flowrate region the latest intake air flowrate $Q_c$ belongs to in response to the intake air flowrate signal S1. As shown in FIG. 10, in this embodiment, six flowrate regions $Q_1$–$Q_6$ is provided.

Then, when the measured intake air flowrate is judged to be in the flowrate $Q_1$ at the time of full closing of the throttle valve 18, the process proceeds to a step S52. In the step S52, a judgement is made whether or not the reference value FAFAV2 is 0.98 or more and less than 1.02. When the judgement is affirmative, the process proceeds to a step S53. In the step S53, the learning amount GKD obtained in the step S23 or S24 as shown in FIG. 8 is added to the obstruction compensating learning correction coefficient $FGQ_1$ allotted to the flowrate region $Q_1$ and 0.002 is added to the reference value FAFAV2. Subsequently, in a step S54, a judgement is made whether or not the obstruction compensating learning correction coefficient $FGQ_1$ is −0.20 or more and less than 0.10. When the correction coefficient $FGQ_1$ is not within this range, the correction coefficient $FGQ_1$ is regulated by −0.20 or 0.10 depending on the amount of $FGQ_1$ in a step S55.

In a next step S56, the learning amount GKF obtained in the step S23 or S24 as shown in FIG. 8 is added to the altitude compensating learning correction coefficient FHAC. Then, in a step S57, a judgement is made as to whether or not the altitude compensating learning correction coefficient FHAC is −0.20 or more and less than 0.10. When the correction coefficient FHAC is not within this range, the correction coefficient FHAC is regulated by −0.20 or 1.0 depending on the amount FHAC in a step S58. Then, in a step S59, a new guard value FHACi is computed from the altitude compensating learning correction coefficient FHAC calculated in the flowrate region $Q_1$ and the preceeding guard value FHACi and stored in a predetermined area.

In a step S60, a judgement is made as to whether the obstruction compensating learning correction coefficients $FGQ_1$–$FGQ_6$ in all of the flowrate regions are all negative or positive. When all of the correction coefficients $FGQ_1$–$FGQ_6$ are judged to be negative because of the motor vehicle climbing the highlands, the process proceeds to a step S61. In the step S61, 0.002 is subtracted from the altitude compensating learning correction coefficient FHAC and 0.002 is added to the obstruction compensating learning correction coefficient $FGQ_1$–$FGQ_6$. In the step S60, when all of the obstruction compensating learning correction coefficient $FGQ_1$–$FGQ_6$ are judged to be positive because of the motor vehicle going down the highlands, in the step S62, 0.002 is added to the altitude compensating learning correction coefficient FHAC and 0.002 is subtracted from the obstruction compensating learning correction coefficients $FGQ_1$–$FGQ_6$, respectively.

In the step S51, when the measured intake air flowrate is judged to be in the flowrate region $Q_2$, the process goes to a step S63 where a judgement is made as to whether the mean value FAFAV1 is 1.0 or more. When the judgement is affirmative, the process proceeds to a step S64, and, when the judgement is negative, the process proceeds to a step S65. In the step S64, 0.002 is added to the obstruction compensating learning correction coefficient $FGQ_2$ allotted to the intake air flowrate region $Q_2$ and 0.001 is added to the obstruction compensating learning correction coefficient $FGQ_3$–$FGQ_6$ allotted to the other flowrate regions $Q_3$–$Q_6$, respectively. Furthermore, 0.004 is added to the altitude compensating learning correction coefficient FHAC. In the step S65, 0.002 is subtracted from the obstruction compensating learning correction coefficient $FGQ_2$ and 0.001 is subtracted from the obstruction compensating learning correction coefficient $FGQ_3$–$FGQ_6$ allotted to the other flowrate regions, respectively. Furthermore, 0.004 is subtracted from the altitude compensating learning correction coefficient FHAC.

In a next step S66, a judgement is made as to whether or not the altitude compensating learning correction coefficient FHAC is equal to a lower limit obtained by subtracting 0.03 from the guard value FHACi or more. When the judgement is negative, the altitude compensating learning correction coefficient FHAC is regulated to the lower limit of (FHACi−0.03) in a step S67, and the process proceeds to a step S68.

In the step S68, a guard value GURD of the obstruction compensating learning correction coefficient $FGQ_2$ allotted to the flowrate region $Q_2$ is determined on the basis of the obstruction compensating correction coefficient $FGQ_1$ allotted to the flowrate region $Q_1$. More specifically, as shown in FIG. 11, the correction coefficient $FGQ_1$ is regarded as a value when the intake air flowrate is 8 $m^3/h$ (in a normal idling condition), the point $P_1$ thereof is connected to a point $P_2$ where the correction coefficient $FGQ_1$ is 0 when the intake air flowrate is 32 $m^3/h$. A value on this segment of the line $P_1$–$P_2$ is made to be a guard value GURD. The obstruction compensating learning correction coefficient $FGQ_2$ allotted to the flowrate region $Q_2$ is regulated as described above, so that the correction coefficient $FGQ_2$ fitting in with the obstruction characteristics of the air flow meter can be obtained.

Then, in a step S69, a judgement is made as to whether or not obstruction compensating learning correction coefficient $FGQ_2$ is within a range of ±0.03 of the guard value GURD. When the correction coefficient $FGQ_2$ is not within this range, the obstruction compensating correction coefficient $FGQ_2$ is regulated to a value of (GURD−0.03) or (GURD+0.03), and the process proceeds to a step S71. In the step S71, a judgement is made as to whether or not the obstruction compensating learning correction coefficient $FGQ_3$–$FGQ_6$ allotted to the flowrate regions $Q_3$–$Q_6$ are within the range of ±0.03. When the correction coefficients $FGQ_3$–$FGQ_6$ are not within this range, the correction coefficients $FGQ_3$–$FGQ_6$ are regulated to −0.03 or 0.03 in a step S72, and subsequently, the process goes through the steps S60 and S61, or the steps S60 and S62, thus completing this process.

Further, in the case of the flowrate regions $Q_3$–$Q_6$, the same process as in the steps S63–S72 of the flowrate region $Q_2$ is to be performed. However, in the steps S64 and S65, a comparatively large value is added to or subtracted from the obstruction compensating learning correction coefficients FGQ allotted to each of the flowrate regions, respectively.

Description will hereunder be given of the routine of computing the learning correction coefficient FG with reference to FIG. 12.

When this routine is started, in the step S71, the current intake air flowrate $Q_c$ is measured on the basis of the intake air flowrate signal S1. When the flowrate $Q_c$ is 8 $m^3/h$ or more and less than 24 $m^3/h$, the proceeds to the step S72. In the step S72, a judgement is made as to whether or not the obstruction compensating learning correction coefficient $FGQ_1$ is less than the correction coefficient $FGQ_2$ allotted to the flowrate region $Q_2$. If the judgement is affirmative, then the process proceeds to a step S73. If the judgement is negative, then the process proceeds to a step S74. In the step S73, the obstruction compensating correction coefficient FGQ at the current flowrate $Q_c$ is determined by the interpolation and stored in a memory area A. The correction coefficient $FGQ_1$ allotted to the flowrate region $Q_1$ is made to be a value of 8 $m^3/h$ as being the center flowrate in the flowrate region $Q_1$, the correction coefficient $FGQ_2$ allotted to the flowrate region $Q_2$ is made to be a value of 24 $m^3/h$ as being the center flowrate in the flowrate region $Q_2$. A value on a line connecting these two values to each other is determined by the interpolation.

Then, in a step S75, a judgement is made as to whether or not the measured intake air flowrate in the current flowrate region $Q_c$ is more than 8 $m^3/h$ and less than 16 $m^3/h$. When the judgement is affirmative, the value thus determined is the learning correction coefficient $FGQ_1$ allotted to the flowrate $Q_1$. Consequently, in a step S76, the value in the memory area A is shifted to a memory area for the correction coefficient $FGQ_{11}$. In the step S75, when the judgement is negative, the value thus determined is the learning correction coefficient $FGQ_2$ allotted to the flowrate region $Q_2$. Consequently, in a step S77, the value in the memory area A is shifted to a memory area for the correction coefficient $FGQ_{22}$.

In the case of the flowrate region $Q_1$, in a step S78, the altitude compensating learning correction coefficient FHAC, the obstruction compensating learning correction coefficient $FGQ_{11}$ and "1" are added together, and the resultant value is stored in a predetermined memory area as the learning correction coefficient FG. Also, in the case of the flowrate region $Q_2$, in a step S79, the computation similar to the above is carried out, and the resultant value is stored in a predetermined memory area as the learning correction coefficient FG.

In the step S71, when the current flowrate $Q_c$ is judged to be 24 $m^3/h$ or more and less than 40 $m^3/h$, the process proceeds to a step S80. In the step S80, a judgement is made as to whether or not the correction coefficient $FGQ_2$ is less than $FGQ_3$ in value. When the judgement is affirmative, the interpolation similar to the step S73 is carried out in the step S81. When the judgement is negative, the interpolation similar to the step S74 is carried out in the step S82. Then, the process proceeds to a step S83. In the step S83, a judgement is made as to whether the current flowrate $Q_c$ is 24 $m^3/h$ or more and less than 32 $m^3/h$. When the judgement is affirmative, the result of the interpolation is stored in a memory area for the learning correction coefficient $FGQ_{21}$ in the step S84. When the judgement is negative, in a step S85, the result of the interpolation is stored in a memory area for the learning correction coefficient $FGQ_{31}$. Upon completion of the step S84, the process proceeds to a step S79, in which the learning correction coefficient FG is determined through the same computation as described above and the resultant value is stored in a predetermined memory area. On the other hand, upon completion of a step S85, in a step S86, the learning correction coefficient FG is determined by use of the obstruction compensating learning correction coefficient $FGQ_{31}$ and the resultant value is stored in a predetermined memory area.

In the step S71, when the current flowrate $Q_c$ is judged to be 40 $m^3/h$ or more and less than 56 $m^3/h$ and judged to be 56 $m^3/h$ or more and less than 72 $m^3/h$, the learning correction coefficient FG corresponding to the respective flowrate regions are computed by the process similar to the case where the current flowrate $Q_c$ is judged to be 24 $m^3/h$ or more and less than 40 $m^3/h$.

On the other hand, in the step S71, when the current flowrate $Q_c$ is judged to be 72 $m^3/h$ or more and less than 88 $m^3/h$, in a step S87, a judgement is made whether or not the correction coefficient $FGQ_5$ is equal to the correction coefficient $FGQ_6$ or more. When the judgement is affirmative, the interpolation similar to the step S73 is carried out in a step S88, and, when the judgement is negative, the interpolation similar to the step S74 is carried out in a step S89.

In a next step S90, a judgement is made as to whether or not the current flowrate $Q_c$ is 72 $m^3/h$ or more and less than 80 $m^3/h$ to thereby judge whether the value computed and stored in the memory area A belongs to the flowrate $Q_5$ or $Q_6$. If the value is judged to belong to the flowrate region $Q_5$, then, in a step S91, the value in the memory area A is shifted to a memory area for the compensating learning correction coefficient $FGQ_{51}$. If the value is judged to belong to the flowrate region $Q_6$, then, in a step S92, the value in the memory area A is shifted to a memory area for the compensating learning correction coefficient $FGQ_{61}$.

Upon completion of the step S91, the process proceeds to a step S93, and, upon completion of the step S92, the process proceeds to a step S94. In these steps S93 and S94, the learning correction coefficient FG is computed similarly to the processes S78, S79 and the like, and the resultant value is stored in a predetermined memory area.

In the step S71, if the current flowrate $Q_c$ is judged to be less than 8 $m^3/h$ and 88 $m^3/h$ or more, then, without carrying out the interpolation of the obstruction learning correction coefficient $FGQ_1$ and $FGQ_6$, in a step S78' or S94', these values are stored in predetermined memory areas as the obstruction compensating learning correction coefficient $FGQ_{11}$ or $FGQ_{61}$. Then, in the step S78 or S94, the learning correction coefficient FG is calculated by use of the correction coefficient $FGQ_{11}$ or $FGQ_{61}$.

In a step 95, the learning correction coefficient FG of the flowrate region $Q_4$ is computed.

Upon completion of the steps S78, S79, S86, S93, S94 and S95, the process proceeds to a step S96 in which a judgement is made as to whether or not the learning correction coefficient FG is −0.25 or more and less than 0.10. When the judgement is negative, in a step S97, the learning correction coefficient FG is regulated to −0.25 or 0.10, thus finishing this routine.

The routine shown in FIG. 12 is the one in which the respective obstruction learning correction coefficients $FGQ_1$–$FGQ_6$ are regarded as the center flowrates 8, 24, 40, 56, 72 and 88 $m^3/h$ for the respective flowrate regions $Q_1$–$Q_6$, and the respective correction coefficients $FGQ_1$–$FGQ_6$ are computed in accordance with the current flowrates by the interpolation.

In the embodiment shown in FIGS. 8, 9 and 12, the learning correction coefficient is rewritten to carry out the learning every five skips of the feedback correction coefficient FAF. The learning is carried out separately of each other in the flowrate region $Q_1$ where the throttle valve 18 is fully closed (during idling), and in each of other five flowrate regions $Q_2$–$Q_5$. At the time of the learning of respective flowrate regions $Q_2$–$Q_5$, in addition to the obstruction compensating learning coefficient FGQ allotted to the corresponding flowrate region, the obstruction compensating learning correction coefficients FGQ allotted to all the flowrate regions other than the flowrate region $Q_1$ is rewritten to be learnt. Then, in the flowrate region $Q_1$, only the obstruction compensating learning correction coefficient $FGQ_1$ thereof is learned. On the other hand, the altitude compensating learning correction coefficient FHAC is learned in every flowrate regions. However, in the flowrate regions $Q_2$–$Q_6$, the lower limit value is determined by the altitude compensating learning correction coefficient FHAC, which has been learned during idling, whereby a temporary change in the air-fuel ratio due to the evaporated fuel is not learned.

Furthermore, when the obstruction compensating learning correction coefficients $FGQ_1$–$FGQ_6$ are all positive or negative, in every flowrate regions, a predetermined number is subtracted from or added to the correction coefficients $FGQ_1$–$FGQ_6$, respectively, and also, a predetermined number is subtracted from or added to the altitude compensating learning correction coefficient FHAC. With this arrangement, the air-fuel ratio after climbing of the highland or after descending from the highland is approached to a proper one only in the specific operating region, thereby improving the drivability.

What is claimed is:

1. A method of controlling air-fuel ratio wherein a basic fuel injection time duration is determined in accordance with an intake air flow rate measured by means for measuring the intake air flow rate and an engine rotational speed, then the basic fuel injection time duration is corrected such that the air-fuel ratio becomes the stoichiometric air-fuel ratio, and an aging of said intake air flow rate measuring means is compensated by learning correction coefficients $FGQ_1$–$FGQ_n$ for obstruction of said intake air flow rate measuring means, said method comprising the steps of:

judging the intake air flow rate as to which flow rate regions $Q_1$–$Q_n$ the intake air flow rate belongs to;

renewing, in accordance with the measured air-fuel ratio, the learning correction coefficient $FGQ_1$ for the flow rate regions $Q_1$ when judging is made that the intake air flow rate Q belongs to the flow rate regions $Q_1$ corresponding to an idle condition and the learning correction coefficient $FGQ_2$–$FGQ_n$ for respective flow rate regions $Q_2$–$Q_n$, respectively, when judging is made that the intake air flow rate Q belongs to one of the flow rate regions $Q_2$–$Q_n$, respectively.

2. A method of controlling air-fuel ratio as set forth in claim 1, wherein each of the learning correction coefficients $FGQ_1$–$FGQ_n$ is increased in response to the air-fuel ratio being rich side of the stoichiometric air-fuel ratio and is decreased in response to the air-fuel ratio being lean side of the stoichiometric air-fuel ratio.

3. A method of controlling air-fuel ratio as set forth in claim 1, wherein a feedback correction coefficient FAF is calculated in accordance with the measured air-fuel ratio so as to increase in response to the air-fuel ratio being lean side of the stoichiometric air-fuel ratio and decrease in response to the air-fuel ratio being rich side of the stoichiometric air-fuel ratio, and the learning correction coefficient $FGQ_1$–$FGQ_n$ is increased when a mean value of the feedback correction coefficient FAF is less than a reference value and decreased when the mean value of the feedback correction coefficient FAF is reference value or more.

4. A method of controlling air-fuel ratio wherein a basic fuel injection time duration is determined in accordance with an intake air flow rate measured by means for measuring the intake air flow rate and an engine rotational speed, then the basic fuel injection time duration is corrected such that the air-fuel ratio becomes the stoichiometric air-fuel ratio, an aging of said intake air flow rate measuring means is compensated by learning correction coefficients $FGQ_1$–$FGQ_n$ for obstruction of said intake air flow rate measuring means and an influence of altitude on the air-fuel ratio is prevented by learning correction coefficient FHAC for altitude of highlands, said method comprising the steps of:

judging the intake air flow rate as to which one of flow rate regions $Q_1$–$Q_n$ the intake air flow rate belongs to;

renewing the learning correction coefficients $FGQ_1$–$FGQ_n$ for the judged flow rate regions $Q_1$–$Q_n$, respectively, in accordance with the measured air-fuel ratio;

decreasing the learning correction coefficients $FGQ_1$–$FGQ_n$ and increasing the learning correction coefficient FHAC when all learning correction coefficients $FGQ_1$–$FGQ_n$ are positive, and increasing the learning correction coefficients $FGQ_1$–$FGQ_n$ and decreasing the learning correction coefficient FHAC when all learning correction coefficients are negative; and renewing the learning correction coefficient FHAC when each of the flow rate regions $Q_1$–$Q_n$ is judged.

5. A method of controlling air-fuel ratio as set forth in claim 4, wherein each of the learning correction coefficients $FGQ_1$–$FGQ_n$ and the learning correction coefficient FHAC are increased in response to the air-fuel ratio being rich side of the stoichiometric air-fuel ratio, respectively, and are decreased in response to the air-fuel ratio being lean side of the stoichiometric air-fuel ratio, respectively.

6. A method of controlling air-fuel ratio as set forth in claim 1, wherein a feedback correction coefficient FAF is calculated in accordance with the measured air-fuel ratio so as to increase in response to the air-fuel ratio being lean side of the stoichiometric air-fuel ratio and decrease in response to the air-fuel ratio being rich side of the stoichiometric air-fuel ratio, and the learning correction coefficient $FGQ_1$–$FGQ_n$ and the learning correction coefficient FHAC are increased when a mean value of the feedback correction coefficient FAF is less than a reference value, respectively, and decreased when the mean value of the feedback correction coefficient FAF is reference value or more, respectively.

7. A method of controlling an air-fuel ratio as set forth in claim 4, wherein:

a lower limit for learning correction coefficient FHAC is set on the basis of the altitude compensating learning correction coefficient FHAC computed when the throttle valve is fully closed;

in the flowrate region $Q_n$ other than the flow rate region $Q_1$, if the altitude compensating learning correction coefficient FHAC is less than the lower limit for learning correction coefficient FHAC, the altitude compensating learning correction coefficient FHAC is regarded as the lower limit thereof.

8. A method of controlling air-fuel ratio wherein a basic fuel injection time duration is determined in accordance with an intake air flow rate measured by means for measuring the intake air flow rate and an engine rotational speed, then the basic fuel injection time duration is corrected such that the air-fuel ratio becomes the stoiohiometric air-fuel ratio, and an aging of said intake air flow rate measuring means is compensated by learning correction coefficients $FGQ_1$–$FGQ_n$ for obstruction of said intake air flow rate measuring means, said method comprising the steps of:

judging the intake air flow rate as to which flow rate regions $Q_1$–$Q_n$ the intake air flow rate belongs to;

renewing, in accordance with the measured air-fuel ratio, the learning correction coefficients $FGQ_1$–$FGQ_n$ for respective flow rate regions $Q_1$–$Q_n$ in accordance with the judged one of flow rate $Q_1$–$Q_n$.

determining a lower limit for the learning correction coefficient FGQ corresponding to the flow rate adjacent to the flow rate region $Q_1$ by a line connecting a point $P_1$ indicative of the learning correction coefficient $FGQ_1$ to a point $P_2$ indicative of zero of the learning correction coefficient FGQ at a predetermined flow rate within a predetermined flow rate region.

9. A method of controlling air-fuel ratio as set forth in claim 8, wherein each of the learning correction coefficients $FGQ_1$–$FGQ_n$ is increased in response to the air-fuel ratio being rich side of the stoichiometric air-fuel ratio and is decreased in response to the air-fuel ratio being lean side of the stoiohiometric air-fuel ratio.

10. A method of controlling air-fuel ratio as set forth in claim 8, wherein a feedback correction coefficient FAF is calculated in accordance with the measured air-fuel ratio so as to increase in response to the air-fuel ratio being lean side of the stoichiometric air-fuel ratio and decrease in response to the air-fuel ratio being rich side of the stoichiometric air-fuel ratio, and the learning correction coefficient $FGQ_1$–$FGQ_n$ is increased when a mean value of the feedback correction coefficient FAF is less than a reference value and decreased when the mean value of the feedback correction coefficient FAF is reference value or more.

* * * * *